United States Patent [19]

Griswold

[11] 4,108,030

[45] Aug. 22, 1978

[54] SLICE EJECTOR FOR SLICING MACHINES

[75] Inventor: George G. Griswold, Fort Wayne, Ind.

[73] Assignee: Peter Eckrich and Sons, Inc., Fort Wayne, Ind.

[21] Appl. No.: 831,299

[22] Filed: Sep. 7, 1977

[51] Int. Cl.[2] ..... B26D 4/46; B26D 4/56

[52] U.S. Cl. ..... 83/77; 83/90

[58] Field of Search ..... 83/77, 86, 90, 91, 92

[56] References Cited

U.S. PATENT DOCUMENTS

| | | | |
|---|---|---|---|
| 2,989,104 | 6/1961 | Good | 83/90 |
| 3,821,913 | 7/1974 | Bajcar et al. | 83/92 |

*Primary Examiner*—Willie G. Abercrombie

*Attorney, Agent, or Firm*—Wegner, Stellman, McCord, Wiles & Wood

[57] ABSTRACT

A stack ejector including a stack receiving platform having a pair of stack supporting surfaces separated by an elongated space, a carriage mounted for reciprocating movement towards and away from the platform generally in the direction of the space, an eccentric for reciprocating the carriage, a stack engaging assembly movably mounted on the carriage and movable therewith through the space and further movable on the carriage between a first position intersecting a plane encompassing the stack supporting surfaces and a second position not intersecting the plane, and structure on the carriage for (a) moving the stack engaging assembly from the first position to the second position at one extreme position of movement of the carriage, (b) maintaining the stack engaging assembly in the second position until the other extreme position of movement is reached, (c) moving the stack engaging assembly to the first position when the other extreme position is reached, and (d) maintaining the stack engaging assembly in the first position until the one extreme position is reached.

7 Claims, 6 Drawing Figures

SLICE EJECTOR FOR SLICING MACHINES

BACKGROUND OF THE INVENTION

This invention relates to stack ejecting devices particularly suitable for use with slicing machines such as food slicing machines; and is particularly suited for use with such slicing machines that are controlled in response to a weight characteristic of the material being sliced.

Food slicing machines of the type utilized in the production of sliced foods typically include a slice receiving platform which receives slides as they are cut from feedstock by a slicer. The slices are retained on the platform until either a predetermined number of slices are cut or a predetermined weight of slices is on the platform, or both, and then rapidly ejected to a packaging line or the like.

In many cases, the slide ejectors have been driven by periodically energized, reciprocating motors, such as pneumatic cylinders or solenoids. While such motors have been generally satisfactory for their intended purpose, because they respond rapidly to the application of power thereto or the removal of power therefrom, some drawbacks may be encountered in various situations. For example, when power is applied to such devices, the rapid response may deform the stack from an orderly configuration in any type of slicer. Moreover, when the slicer is provided with weight control apparatus which may, for example, monitor slice weight to ensure that the stack of slices is cut to a predetermined weight, the rapid vibration caused by the sudden startup and shutdown of such motors may generate noise in the output from the weight cell controlling the slicing operation. As a consequence, erratic weight control results. This, in turn, has resulted in far lesser usage of weight controlled slicing systems than might be expected because the advantages that should be produced thereby are reduced by the cost of the control system and the erratic performance thereof.

SUMMARY OF THE INVENTION

It is the principal object of the invention to provide a new and improved stack ejector. More specifically, it is an object of the invention to provide such a stack ejector which is ideally suited for use in slicing systems and which will not deform the stack during the ejection process and/or produce considerable vibration which could cause a weight control system for a slicer to perform erratically.

An exemplary embodiment of the invention achieves the foregoing objects in a structure including a slice receiving platform having a pair of stack supporting surfaces separated by an elongated space. A carriage is mounted for reciprocating movement towards and away from the platform generally in the direction of the space. Means are provided for reciprocating the carriage and a stack engaging assembly is movably mounted on the carriage and is movable therewith through the space. The stack engaging assembly is further movable on the carriage between a first position intersecting the plane encompassing the stack supporting surfaces and a second position not intersecting the plane. Means are disposed on the carriage for moving the stack engaging assembly from the first position to the second position at one extreme position of movement of the carriage, for maintaining the stack engaging assembly in the second position until the other extreme position of movement is reached, moving the stack engaging assembly to the first position when the other extreme position is reached, and maintaining the stack engaging assembly in the first position until one extreme position is reached.

In a highly preferred embodiment, the means for reciprocating the carriage comprises an eccentric whereby at the extreme positions of movement of the carriage, its movement is relatively slow and yet will be sufficiently rapid in between such extremes of movement that the ejection process can be completed rapidly and with sufficient speed to be utilized in a high speed slicing system. As a consequence, vibration which has accomplished the operation of prior art machines is minimized or eliminated, allowing the slice ejector to be used with efficacy with weight control slide ejecting systems.

In a highly preferred embodiment, the slice ejector is utilized with a slicing machine and includes a one-revolution clutch connected between the eccentric and a drive source. A slice counter is provided for actuating the one-revolution clutch after a predetermined number of slices have been cut.

In a highly preferred embodiment, there is provided a lost motion connection between the reciprocating drive and a non-lost motion connection between the reciprocating drive and the stack engaging assembly. Cam means interconnect the stack engaging means to the carriage and are responsive to relative movement therebetween for moving the stack engaging means between the first and second positions. Stop means are provided for limiting reciprocal movement of the carriage so that the relative movement between the carriage and the stack engaging assembly is effected.

In one embodiment of the invention, means are frictionally interposed between the carriage and the stack engaging assembly for tending to maintain the stack engaging assembly in one or the other of the first and second positions.

Other objects and advantages will become apparent from the following specification taken in connection with the accompanying drawings.

DESCRIPTION OF THE PREFERRED EMBODIMENT

Figure 1:
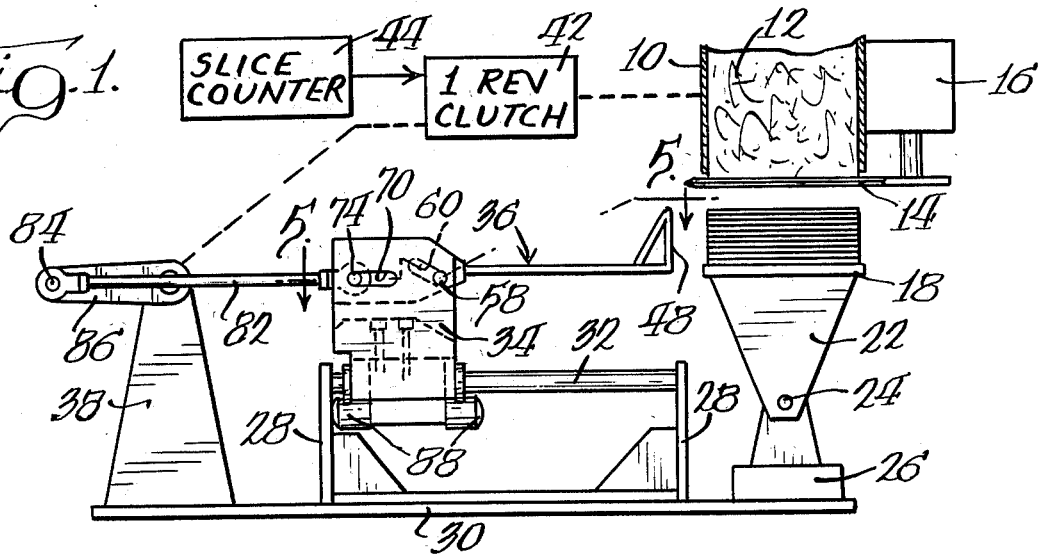
FIG. 1 is a side elevation, in somewhat schematic form, of a slicing system employing a stack ejector made according to the invention at the initiation of a stack ejecting sequence.
Figure 2:
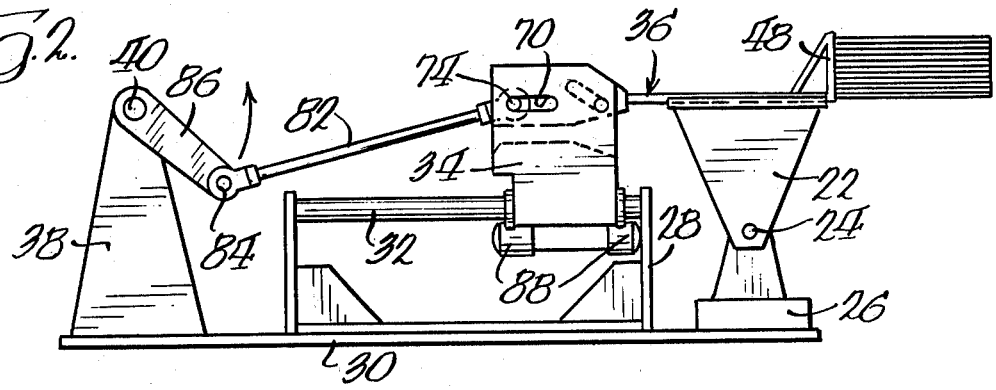
FIG. 2 is a view similar to FIG. 1 illustrating the configuration of the components at a subsequent step in the ejection process.
Figure 5:
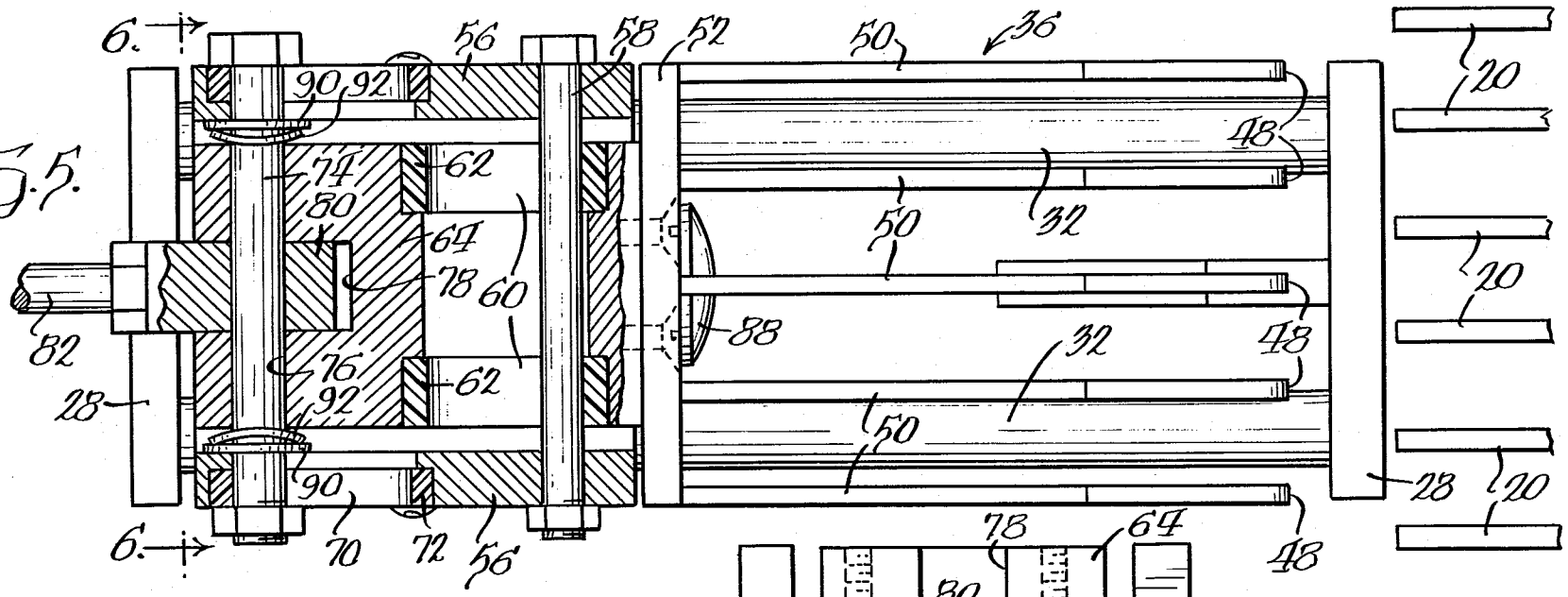
FIG. 5 is an enlarged, sectional view taken approximately along the line 5—5 of FIG. 1.

An exemplary embodiment of a slicing system employing a slice ejector made according to the invention is illustrated in the drawings and, with reference to FIG. 1, is seen to include a feeding device 10 which may be of conventional construction for advancing a loaf 12 of, for example, meat or cheese, in a vertical path towards a rotating slicing knife 14. The knife 14 is driven by a motor 16. Below the knife 14 is a slice or stack receiving platform 18 which, as best seen in FIG. 5, is defined by a plurality of elongated rails 20 which are spaced.

The rails 20 are supported by a stand 22 (FIG. 1) which includes an adjustment means 24, which may be of conventional construction, whereby the position of the platform 18 with respect to the knife 14 may be selectively adjusted. The components 18, 22 and 24 are in turn supported by a transducer or weigh cell 26 of conventional construction which may be utilized to generate an electrical output or the like to a control system for the slicer in response to the weight of the accumulated stack of slices on the platform 18.

The slice ejector includes two upstanding plates 28 mounted on a base 30 and two rods 32 extend therebetween. The rods 32 are generally parallel to the rails 20, as can be seen in FIG. 5, and reciprocally mount a carriage 34 for movement towards and away from the platform 18. The carriage 34, in turn, mounts a stack engaging assembly, generally designated 36, which, in the embodiment illustrated, is a slice pushing assembly, for movement with the carriage 34. As will be seen hereinafter, the stack engaging assembly 36 is also mounted for movement relative to the carriage 34.

A pedestal 38 extends upwardly from the base 30 and journals a shaft 40. The shaft 40 is driven through a one-revolution clutch 42 of conventional construction which, in turn, may be driven by the motor 16, as schematically illustrated in FIG. 1. The one-revolution clutch 2 is of the type that, when signaled to engage, will couple the motor 16 to the shaft 40 for but a single revolution and then disengage until again signaled. In the present case, the one-revolution clutch 42 is signaled to engage by a conventional slice counter 44 which actuates the clutch 42 whenever a predetermined number of slices have been cut and have accumulated on the platform 18. However, it is to be understood that the one-revolution clutch could be energized by a signal from the weigh cell 26 whenever a predetermined weight of slices has been accumulated on the platform 18 or, for that matter, the clutch 42 could be signaled to engage in response to both weight and slice count.

According to the present invention, it is desired to minimize the speed of the pusher assembly 36 through the platform area to reduce vibration which could affect the readout of the weigh cell 26. In prior art ejectors, the ejector assembly typically reciprocates through the area between the platform 18 and the knife 14 and thus there must be sufficient time in the slicing cycle for the pusher assembly to move in both directions therethrough.

According to the present invention, the pusher assembly 36 is advanced only through the area between the platform 18 and the knife 14 and is retracted through a path outside of that area. Thus, for a given slicing speed, the ejector of the present invention can travel at half the speed of prior art ejectors. This is accomplished by lowering the stack engaging surface 48 of the stack engaging assembly 36 between the rails 20 after ejection has occurred and returning the stack engaging assembly 36 to its initial position in a path that is below the platform 18.

As seen in FIG. 5, the stack engaging assembly 36 is defined by a plurality of rods 50 which extend from a plate 52 in the direction of the platform 18 and are aligned with the elongated spaces between the rails 20. The stack engaging surfaces 48 are merely bent-up portions of the rods 50 and are of suitable height so as to engage all slices in the highest stack contemplated to be received on the platform 18.

The carriage 34 is defined by two upwardly extending, interconnected side members 56 (FIGS. 5 and 6) and at their end nearest the platform 18, a rod 58 extends therethrough. The rod 58 acts as a cam follower and passes through elongated, diagonally oriented slots 60 formed in low friction, plastic inserts 62 carried in a block 64 to which the plate 52 is secured.

The side members 56 also include a generally horizontally extending elongated slot 70 defined by low friction, plastic inserts 72 suitably held in place by any desired means. A pivot pin 74 extends through the slots 70 and through a bore 76 in the block 64. A recess 78 in the block receives one end 80 of a connecting rod 82 and the pin 74 thereby pivotally connects the connecting rod 82 to the stack engaging assembly while establishing a lost motion connection and a pivotal connection between the stack engaging assembly 36 and the carriage 34.

As seen in FIGS. 1–4, the end of the connecting rod 82 opposite from the end 80 is connected by a pivot 84 to an eccentric 86 on the shaft 40. Consequently, rotation of the shaft 40 will cause reciprocation of the carriage and the slice engaging assembly 36 towards and away from the platform 18. The throw of the eccentric 86, that is, the diameter of the circle described by the pivot point 84 when rotated by the shaft 40, is greater than the path of travel of the carriage 34 between the plates 28. In this connection, the plates 28 act as stop means for limiting the movement of the carriage, the limiting action being provided by the engagement of rubber bumpers 88 carried by the carriage 34 with the facing surfaces of the plates 28.

Figure 6:
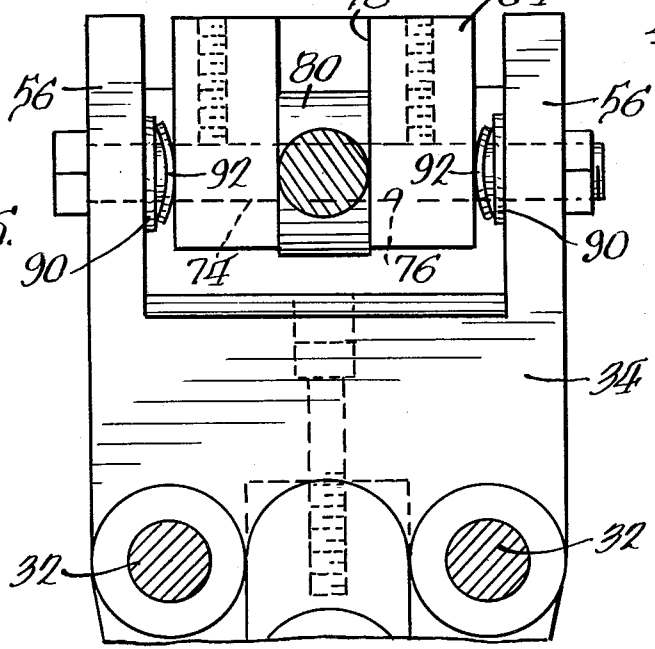
FIG. 6 is an enlarged, sectional view taken approximately along the line 6—6 in FIG. 6.

The essentials of the ejector mechanism are completed by the provision of means frictionally interengaging the stack engaging assembly 36 and the carriage 34 which tend to preclude relative movement therebetween. With reference to FIGS. 5 and 6, at the interface between the block 64 and the side members 26, there are provided, on the pivot pin 74, respective flat washers 90 engaged by stressed Belleville washers 92. Because the Belleville washers are stressed, they tend to preclude relative rotation of the block 64 on the pin 74 relative to the carriage and further tend to prevent sliding movement of the pin 74 within the slot 70.

Operation is as follows. Initially, the components will be in the configuration illustrated in FIG. 1. At some point in time, the desired number of slices or a desired weight of slices will acccumulate on the platform 18 and the one-revolution clutch 42 still will then be engaged. The shaft 40 will then begin to rotate in a counterclockwise direction, thereby driving the stack engaging surfaces 48 to the right, as viewed in FIG. 1, to eject the stack from the platform 18 onto a take-away conveyor (not shown) or the like. At some point in time, the shaft 40 will have rotated to the position illustrated in FIG. 2 whereat the rightmost bumpers 88 have engaged the rightmost one of the plates 28 thereby halting further movement of the carriage 34. However, since the throw of the eccentric 86 is greater than the length of the path of travel of the carriage 34, continued rotation of the shaft 40 will cause the components to assume the configuration illustrated in FIG. 3. It will be observed that the pin 74 has been driven to the right-hand end of the slot 70 and that the slice engaging assembly 36 has been also driven to the right relative to the carriage 34 and downwardly due to the interaction of the cam follower defined by the pin 58 and the slots 60. It will also be observed that the stack engaging surfaces 48 are wholly below the plane defined by the rails 20.

Figure 3:
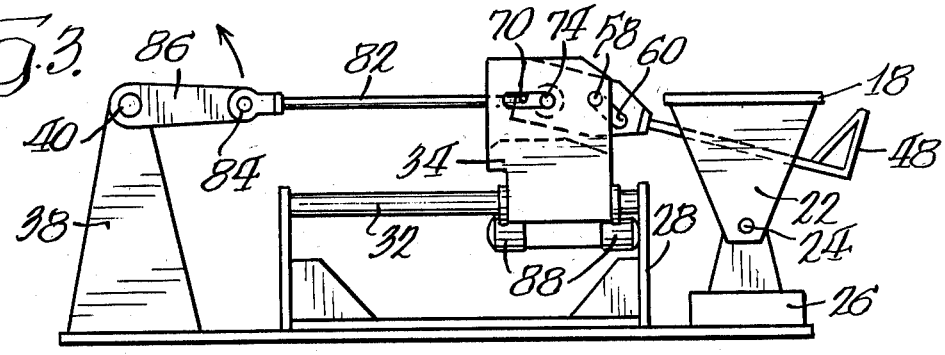
FIG. 3 is a view similar to FIGS. 1 and 2 illustrating still a further step in the ejection sequence.
Figure 4:
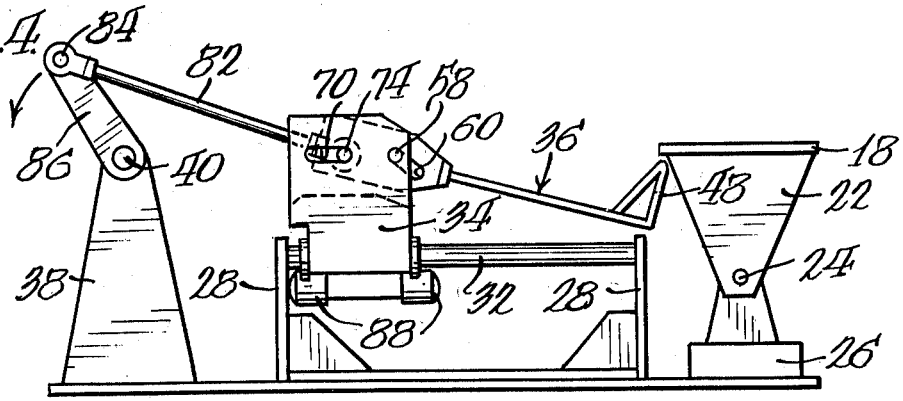
FIG. 4 is a view similar to that of FIGS. 1–3 illustrating still a further step in the ejection process.

Continued rotation of the shaft 40 from the position illustrated in FIG. 3 will draw the carriage 34 to the left but due to the frictional interengaging of the stack engaging assembly 36 and the carriage 34, during such movement, the pin 74 will remain in the right-hand end of the slots 70 until the components assume the configuration illustrated in FIG. 4. At this point in time, the leftmost bumpers 88 have engaged the leftmost plate 28, thereby halting further leftward movement of the carriage 34. The shaft will continue to rotate until the eccentric 86 is in the position illustrated in FIG. 1, at which time the one-revolution clutch 42 will disengage. During such further movement, the pin 74 will have shifted to the lefthand end of the slots 70 drawing with it the slice engaging assembly with respect to the carriage 34, the cam follower 58 will again move to the right-hand end of the cam slot 60 to elevate the stack engaging surfaces 48 to the position illustrated in FIG. 1 so that the ejection mechanism is again ready to initiate an ejection cycle upon energization of the one-revolution clutch.

From the foregoing, it will be appreciated that by reason of the withdrawal of the stack engaging assembly 36 through an area remote from that in which the slides are accumulated, the ejection mechanism can operate at a considerably lower speed to minimize the vibration that would disturb weigh cell readings and cause erratic weight control. Moreover, through use of the eccentric, and the fact that startup of the ejection cycle as well as direction changes of the stack engaging assembly 36 occur at so-called "dead center" of the eccentric, accelerational forces will be minimal, the carriage 34 moving very slowly at and near its extreme positions of movement while yet moving rapidly in between such positions at a sufficient speed to allow utilization in high speed slicing machines. This type of movement, which is sine-cosine in nature, further reduces vibration by minimizing inertial forces and eliminates the possibility of distortion of the stack by the ejection mechanism. And, while an eccentric is utilized in the preferred embodiment to produce such motion, other mechanims having a sine-cosine, reciprocating output may be utilized in lieu thereof.

The ejection mechanism can be used with efficacy in variable speed slicing systems by reason of its direct coupling to the slicer main drive. When so used, there is no need for timing advance circuits or mechanisms customarily employed in variable speed slicing systems using solenoids, cylinders, etc., to drive the ejector thereby providing a cost saving by eliminating parts.

It will also be appreciated that the preferred embodiment illustrated is quite simple in construction, thereby providing the further advantage of low cost assembly and maintenance.

I claim:

1. a stack ejector comprising:

a stack receiving platform having a pair of stack supporting surfaces separated by an elongated space;

a carriage mounted for reciprocation movement towards and away from said platform generally in the direction of said space;

means for reciprocating said carriage;

a stack engaging assembly movably mounted on said carriage and movable therewith through said space and further movable on the carriage between a first position intersecting a plane encompassing said surfaces and a second position not intersecting said plane; and means on said carriage for (a) moving said stack engaging assembly from said first position to said second position at one extreme position of movement of said carriage, (b) maintaining said stack engaging assembly in said second position until the other extreme position of movement is reached, (c) moving said stack engaging assembly to said first position when said other extreme position is reached, and (d) maintaining said stack engaging assembly in said first position until said one extreme position is reached.

2. The stack ejector of claim 1 wherein said reciprocating means includes an eccentric whereby said carriage is moved rapidly between said extreme positions and slowly near and at said extreme positions to minimize vibration; and further including a weigh cell connected to said platform.

3. A slicing apparatus including the stack ejector of claim 2 and further including slicing means adjacent said platform for cutting slices from a feed stock and directing the slices to said platform, a one-revolution clutch and connected between said eccentric and a drive source, and a slice counter for actuating said one-revolution clutch after a predetermined number of slices have been cut.

4. A stack ejector comprising:

a stack receiving platform having a pair of stack supporting surfaces separated by an elongated space;

a carriage mounted for reciprocating movement towards and away from said platform generally in the direction of said space;

means for reciprocating said carriage;

a stack engaging assembly movably mounted on said carriage and movable therewith through said space and further movable on the carriage between a first position intersecting a plane encompassing said surfaces and a second position not intersecting said plane;

said reciprocating means including a lost motion connection to said carriage and a non-lost motion, movable connection to said stack engaging assembly;

cam means interconnecting said stack engaging assembly to said carriage and responsive to relative movement therebetween for moving said stack engaging means between said first and second positions;

stop means for limiting reciprocal movement of said carriage whereby said relative movement is effected; and means frictionally interposed between said carriage and said stack engaging assembly for tending to maintain said stack engaging assembly in one or the other of said first and second positions.

5. The stack ejector of claim 4 wherein said lost motion connection comprises a pin and slot connection; said movable connection comprises a pivot; and said cam means comprises an elongated cam track skewed with respect to said pin and slot connection.

6. The stack ejector of claim 5 wherein the pin of said pin and slot connection comprises said pivot, and said frictionally interposed means comprise a stressed Belleville washer on said pin between said carriage and said stack engaging assembly.

7. A stack ejector comprising:

a stack receiving platform defined by a plurality of spaced, generally parallel rails;

a pair of spaced rods extending generally parallel to said rails;

support plates supporting the ends of said rods;

a carriage mounted on said rods for reciprocating movement thereon toward and away from said platform, carriage movement being limited by said support plates;

an eccentric for reciprocating said carriage and having a throw longer than the length of the path of travel of said carriage between said support plates;

a stack engaging assembly reciprocably connected to said eccentric and connected by a lost motion, pivotal connection to said carriage, said stack engaging assembly including spaced stack engaging surfaces movable between said rails; and a cam interconnecting said stack engaging assembly to said carriage remote from said lost motion pivotal connection for pivoting said stack engaging assembly on said carriage.

* * * * *